US008408360B2

(12) United States Patent
Postma

(10) Patent No.: US 8,408,360 B2
(45) Date of Patent: Apr. 2, 2013

(54) AUTOMATIC BELAY WARNING SYSTEM

(75) Inventor: Nathan B. Postma, White Bear Lake, MN (US)

(73) Assignee: NICROS, Inc., St. Paul, MN (US)

( * ) Notice: Subject to any disclaimer, the term of this patent is extended or adjusted under 35 U.S.C. 154(b) by 1000 days.

(21) Appl. No.: 12/025,424

(22) Filed: Feb. 4, 2008

(65) Prior Publication Data

US 2008/0185221 A1 Aug. 7, 2008

Related U.S. Application Data

(60) Provisional application No. 60/899,104, filed on Feb. 2, 2007.

(51) Int. Cl.
*E06C 5/44* (2006.01)

(52) U.S. Cl. ..... 182/18; 182/19; 182/42; 482/37

(58) Field of Classification Search ..... 182/10, 182/18, 19, 42; 482/37
See application file for complete search history.

(56) References Cited

U.S. PATENT DOCUMENTS

| | | | | |
|---|---|---|---|---|
| 4,252,214 | A | 2/1981 | Miller | 182/8 |
| 4,449,716 | A | 5/1984 | Goldy et al. | 272/109 |
| 4,941,548 | A | 7/1990 | Blanchard | 182/234 |
| 4,997,064 | A | 3/1991 | Motte et al. | 182/231 |
| 5,092,587 | A | 3/1992 | Ulner et al. | 272/112 |
| 5,125,877 | A | 6/1992 | Brewer | 482/7 |
| 5,254,058 | A | 10/1993 | Savigny | 482/37 |
| 5,256,116 | A | 10/1993 | Robinson | 402/37 |
| 5,543,185 | A | 8/1996 | Christensen | 428/15 |
| 5,593,368 | A | 1/1997 | Checketts | 482/27 |
| 5,732,954 | A | 3/1998 | Strickler et al. | 273/441 |
| 5,941,041 | A | 8/1999 | Robinson et al. | 52/591.4 |
| 5,944,634 | A | 8/1999 | Neves | 482/37 |
| 6,080,153 | A | 6/2000 | Mata et al. | 606/54 |
| 6,083,142 | A | 7/2000 | Wilson | 482/37 |
| 6,231,482 | B1 | 5/2001 | Thompson | |
| 6,390,952 | B1 | 5/2002 | Wilson | 482/37 |
| 6,402,663 | B1 | 6/2002 | Popp | 482/35 |
| 6,514,178 | B2 | 2/2003 | Vettori | 482/37 |
| 6,540,645 | B1 | 4/2003 | Zeilinger | 482/35 |

(Continued)

FOREIGN PATENT DOCUMENTS

| | | |
|---|---|---|
| KR | 20-0370509 Y1 | 12/2004 |
| WO | WO 81/01107 | 4/1981 |

(Continued)

OTHER PUBLICATIONS

PCT International Search Report, Jun. 9, 2008.

*Primary Examiner* — Alvin Chin Shue
*Assistant Examiner* — Colleen M Chavchavadze
(74) *Attorney, Agent, or Firm* — Westman, Champlin & Kelly, P.A.; Z. Peter Sawicki

(57) ABSTRACT

A warning system for use with a climbing wall and an automatic belay apparatus for belaying a climber, the warning system providing a warning that a climber is not protected by the auto-belay apparatus. The warning system includes a sensor positioned to sense that a lower end of the climbing rope is secured to the climbing wall and the climber is not attached to the auto-belay system which indicates a dangerous situation, and a height sensor for sensing when the climber has reached a selected height on the climbing wall. A processor receives signals from the sensors and compares the signals to determine if the climber has reached the selected height with the lower end of the climbing wall still secured to the wall, and if so, then actuates a warning alarm.

15 Claims, 6 Drawing Sheets

U.S. PATENT DOCUMENTS

| | | | | |
|---|---|---|---|---|
| 6,551,216 | B2 | 4/2003 | Rennex | 482/35 |
| 6,629,907 | B2 | 10/2003 | Popp | 482/35 |
| 6,709,365 | B2 | 3/2004 | Zeilinger | 482/35 |
| 6,849,031 | B2 | 2/2005 | Paci | 482/37 |
| 6,872,167 | B1 | 3/2005 | Meissner | 482/37 |
| 6,942,600 | B2 | 9/2005 | Zeilinger | 482/35 |
| 6,966,403 | B1 * | 11/2005 | Chandra | 182/18 |
| 7,056,266 | B2 | 6/2006 | Sudeith | 482/37 |
| 7,131,936 | B2 | 11/2006 | Schlosser | 482/69 |
| 7,370,725 | B1 * | 5/2008 | Dornfeld | 182/2.2 |
| 7,600,610 | B2 * | 10/2009 | Deuer | 182/8 |
| 7,798,288 | B2 * | 9/2010 | Blasek | 182/42 |
| 2002/0046903 | A1 | 4/2002 | Strickler | 182/36 |
| 2004/0238277 | A1 | 12/2004 | Kruse | 182/36 |
| 2006/0116244 | A1 | 6/2006 | Postma et al. | 482/37 |
| 2006/0258511 | A1 | 11/2006 | Postma | 482/35 |
| 2009/0211846 | A1 * | 8/2009 | Taylor | 182/231 |

FOREIGN PATENT DOCUMENTS

| | | |
|---|---|---|
| WO | WO 91/08806 | 6/1991 |
| WO | 2006111737 A1 | 10/2006 |

* cited by examiner

AUTOMATIC BELAY WARNING SYSTEM

CROSS-REFERENCE TO RELATED APPLICATION

The present application is based on and claims the benefit of U.S. provisional patent application Ser. No. 60/899,104, filed Feb. 2, 2007, the content of which is hereby incorporated by reference in its entirety.

BACKGROUND

The present invention relates to automatic belay (auto-belay) devices for use in climbing artificial rock climbing structures, and in particular, to a device that helps ensure that an auto-belay device has been attached to the rock climber's harness.

Rock climbing has increased in popularity over the last few decades. With the increase in popularity of rock climbing, indoor artificial climbing walls have become common place. Such structures are provided with "holds" which the climber grabs, pulls on, and steps on in order to ascend or traverse the artificial rock structure. For safety purposes and to encourage inexperienced climbers to enter this sport and use the artificial rock climbing structures, belaying is used to prevent the climber from injury if the climber loses his grip and falls from the climbing wall.

In a conventional top roped belay system, the climber is attached to one end of the rope with the rope extending upwardly above the climbing wall to a pulley or top anchor structure that is secured overhead. The other end of the rope extends downwardly to the climber's partner (belayer) who controls feeding of the rope to the climber. The climber is protected from the consequences of a fall by the belayer's ability to use a belay tool (brake device) to arrest the fall. This system relies greatly on the belayer's concentration and skill level in making the climber's ascent safe.

Due to the experience level needed for a belayer to affect a proper belay and the training required for both belayer and climber, auto-belay devices have been developed for use in indoor climbing. Several types of auto-belay devices have been developed. Some of these devices are spring-loaded reels that take up slack while the climber is ascending and utilize a braking system if the climber falls or during the climber's descent. One such commercially available auto-belay system is sold under the Redpoint Descender trademark. Another type of auto-belay system is based on hydraulicals. An example of one commercially available hydraulically operated system is described in U.S. Pat. Nos. 6,083,142 and 6,390,952. This system is commercially available from Extreme Engineering LLC of New Castle, Calif. It is essentially a hydraulic piston mechanism that pushes apart a pair of pulley assemblies around which the climbing cable or rope extends. As the climber ascends, the slack in the climbing rope or cable is taken up by the hydraulic piston pushing apart the pulley assemblies.

For the most part, all forms of auto-belay devices, if maintained properly, work well and prevent injuries. However, in order for an auto-belay device to function to protect the climber from a fall, the climber must first hookup or attach his or her harness to the auto-belay device prior to ascending the climbing structure. Since the auto-belay device does not require a partner, the climber must remember to attach to the auto-belay device before climbing. The vast majority of the time, climbers do remember to attach to the auto-belay device. However, on occasion a climber may forget to attach to the auto-belay device and start to ascend the climbing wall with occasionally disastrous results. Injuries from falls occur despite the fact that most artificial climbing walls utilize a cushioned landing surface. Such incidences occur even to very experienced climbers that simply forget to attach the auto-belay device to their harness. As the number of people participating in this sport increases, these incidences will also increase.

SUMMARY OF THE INVENTION

The present invention includes an apparatus or a system that warns the climber that the climber is not protected by the auto-belay device. The apparatus includes a sensing system that senses if the auto-belay device is functioning properly, and a climber sensing system which senses whether the climber has detached the auto-belay clip from the wall implying the auto-belay device is attached to the climber's harness.

DETAILED DESCRIPTION OF ILLUSTRATIVE EMBODIMENTS

Figure 1:
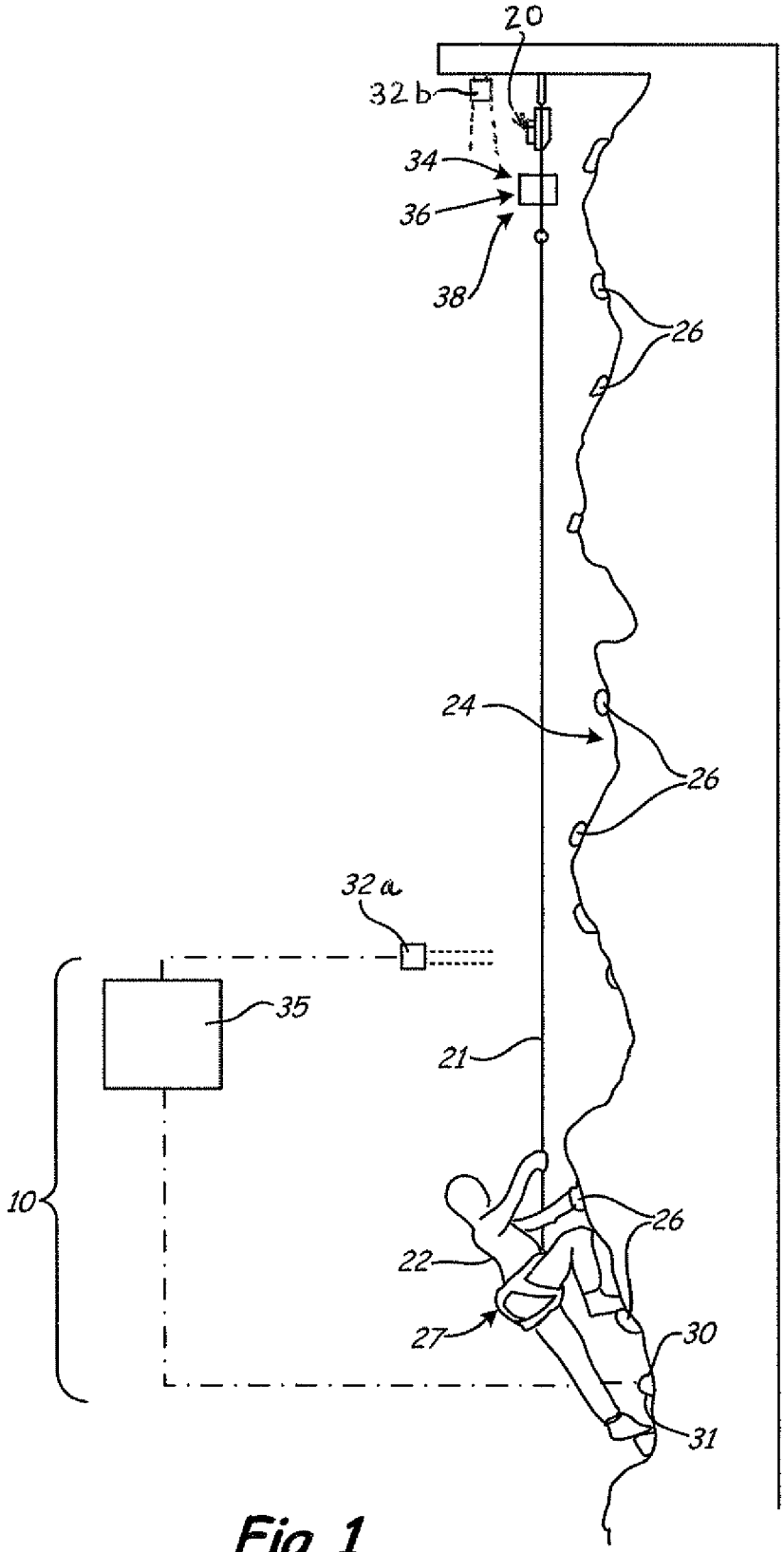
FIG. 1 is a side view illustrating a climber using the warning system of the present invention with one type of auto-belay device.
Figure 2:
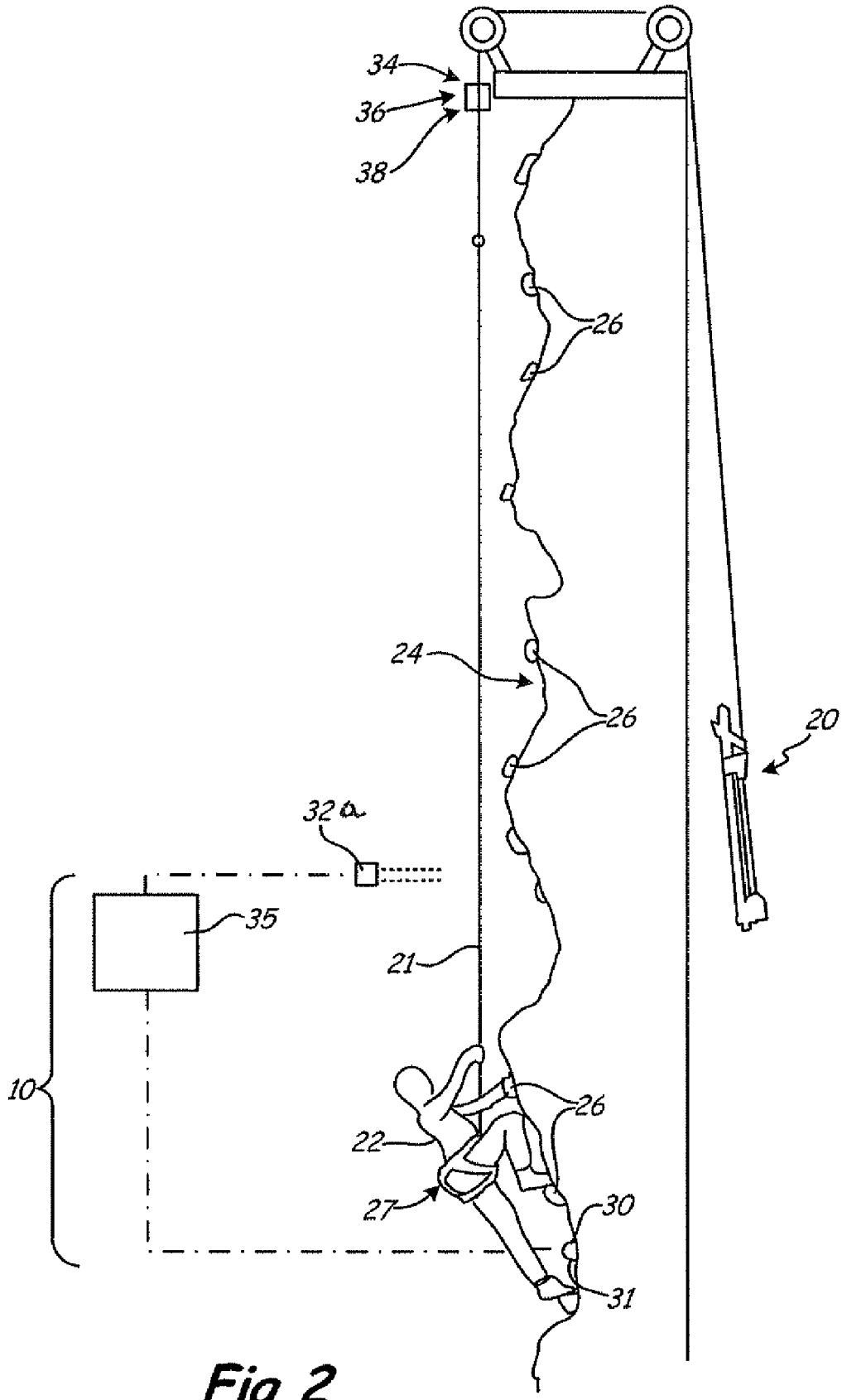
FIG. 2 is a side view illustrating a climber using the system of the present invention with another type of auto-belay system.

An auto-belay warning device of the present invention is generally indicated at 10 in FIGS. 1 and 2. Like reference characters will be used to indicate like elements throughout the figures. The device 10 in one aspect is a warning device used with an auto-belay system 20. The auto-belay warning system aids in reducing the likelihood of a climber 22 forgetting to attach to ("clip in") the auto-belay system.

The device of the present invention is used generally on an artificial rock climbing structure 24. Structure 24 includes a plurality of various types of footholds and hand holds 26 that the climber 22 uses to ascend the wall 24.

Figure 3:
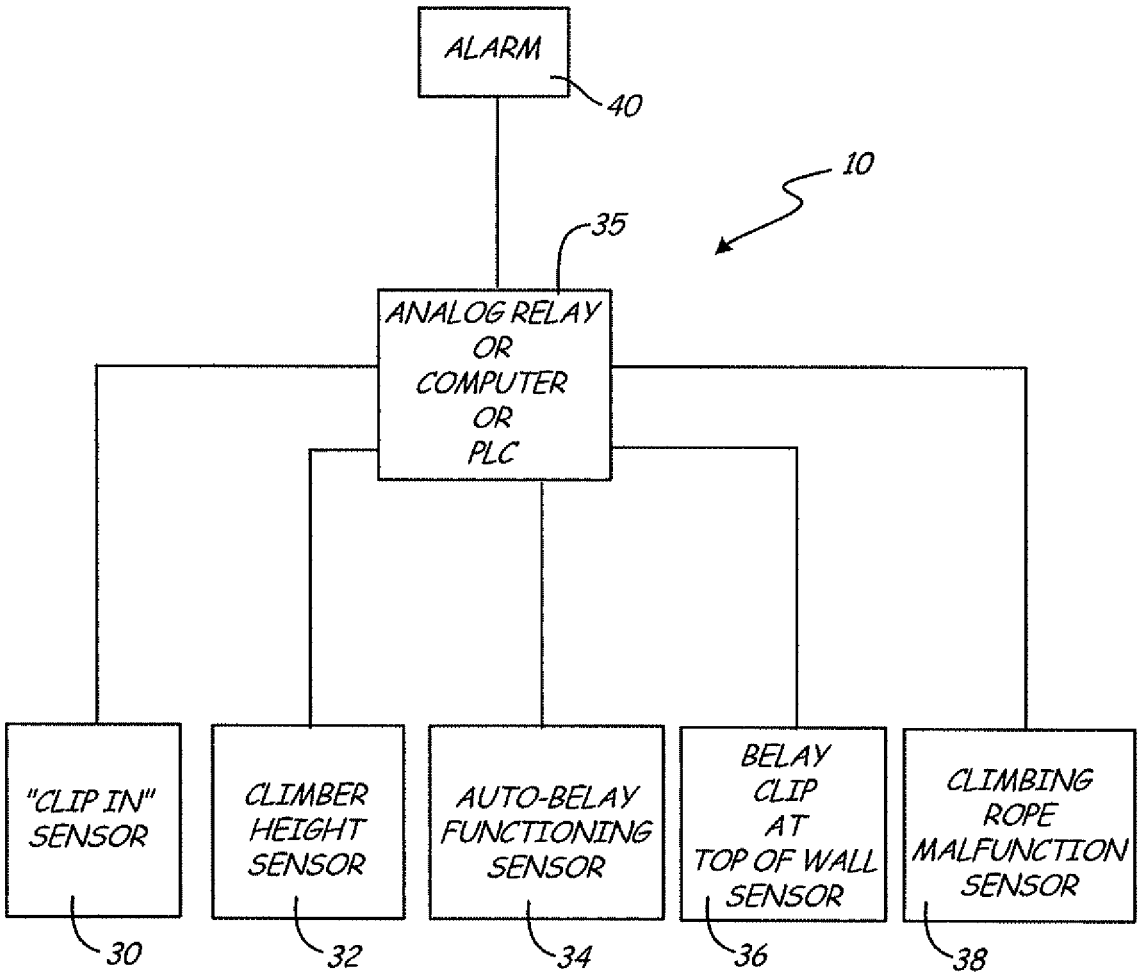
FIG. 3 is a diagrammatical view of the sensing and computer system of the present invention.

To ensure that the climber "clips in" to the auto-belay system. The auto-belay warning system 10 includes a "clip in" sensor 30 and a climber height sensor 32, each of the sensors 30 and 32 providing signals to an analog relayed hard wired system 35. A computer or a programmable logic controller (PLC) may be used instead of the analog relayed hard-wired system. Additionally, the warning system 10 may include an auto-belay functioning sensor 34, a belay-clip-at-the-top-of-the wall sensor 36, and a climbing rope malfunction sensor 38, each of these sensors also providing signals to the analog system 35 as illustrated in FIG. 3. An alarm 40 warns the climber and/or climbing facility's staff and/or supervisor that a potentially dangerous condition exists or has occurred. Several other sensors, discussed further, may also provide signals of potentially unsafe conditions existing to the analog system 35.

The computer system also includes an ASI (Advanced Switching Interconnect) PCI (Peripheral Component Interconnect) computer interface. The ASI network technology ties all the inputs and outputs together. The PCI card brings all the data into the analog system 35 for controlling and recording plus an output for remote notification including an optional wireless pager.

Figure 4:
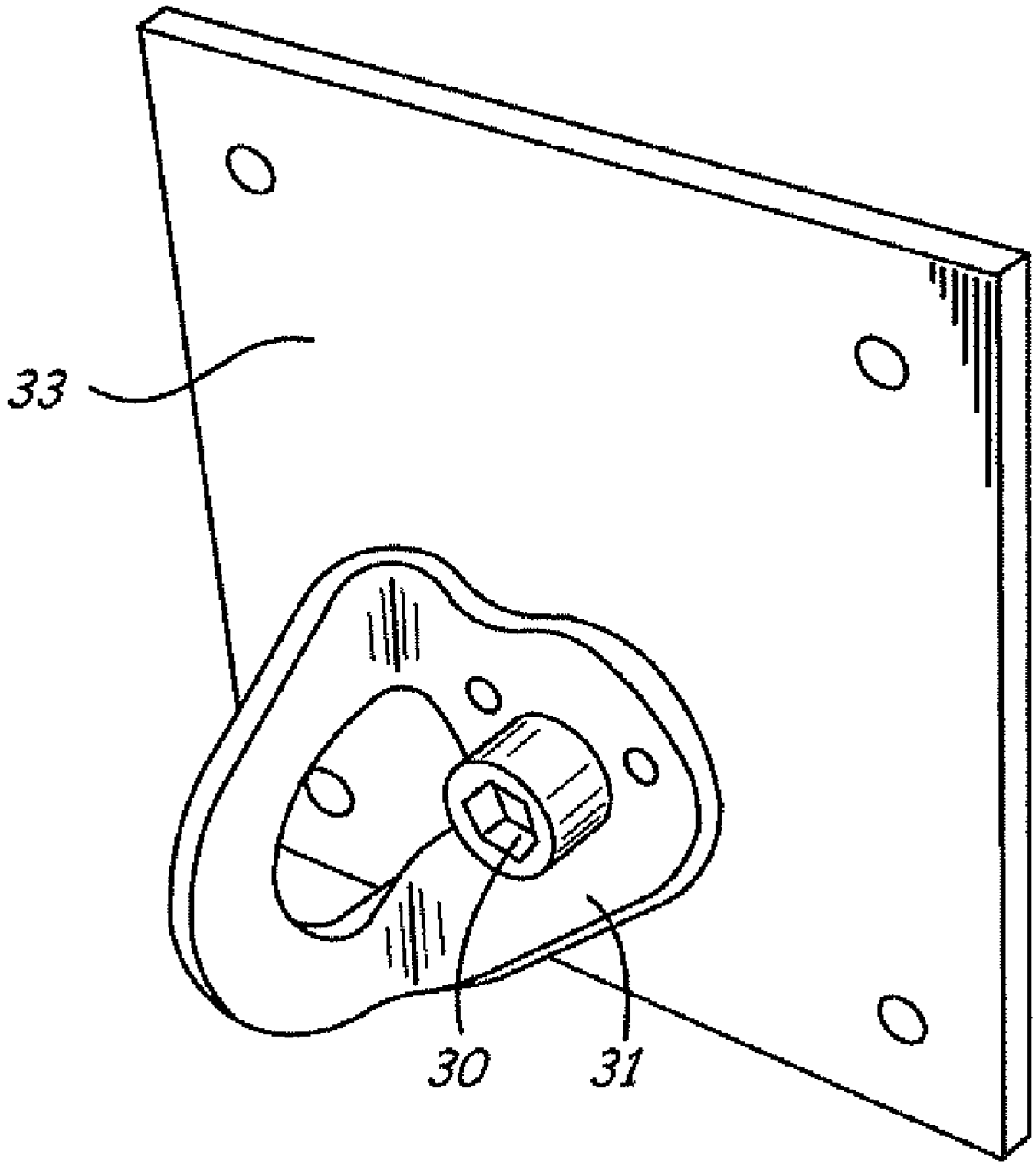
FIG. 4 is a perspective view of abolt hanger plate of the present invention.

One system component of the present invention includes the "clip in" sensor 30, the climbing height sensor 32. As best illustrated in FIGS. 1 and 2, the "clip in" sensor 30 senses whether or not the climber has clipped in (attached) the auto-belay 20 to the sit harness 27 that is strapped on the climber. Although a sit harness 27 is described and shown in the drawings, a full body harness, a chest harness, or any other type of harness is within the scope of the present invention. The sit harness includes a clip (not shown) which attaches to a climbing rope or cable 21 of the auto-belay. As used herein, the words "climbing rope" and "cable" are used interchangeably herein. The sensor 30 can be a switch that is positioned on a bolt hanger 31 attached to the climbing wall 24. The bolt hanger 31 is best illustrated in FIG. 4. The embodiment illustrated in FIG. 4 includes a mounting plate 33 that mounts the bolt hanger 31 onto the wall 30. The auto-belay is normally attached to the bolt hanger when not in use by the climber. When the climber attempts to climb the climbing wall 24, the auto-belay is detached from the bolt hanger 31 and the sensor 30 thereby senses that the auto-belay climbing rope has been detached from the bolt hanger 31.

The climber height sensor 32 is a sensor that detects the climber when the climber reaches a selected height. The height can be any selected height, but is desirably a height above which, if the climber falls and was not clipped into the belay system, the fall could injure the climber. Typically, this height would be approximately 12 feet. Since this is the typical maximum height for bouldering unroped. One or more suitable types of sensors can be used for sensor 32. Such suitable sensors include ultrasonic sensors, motion sensors, photo-electric sensors, infrared sensors, radio frequency sensors, optical sensors, laser sensors or any other suitable sensors. The sensor 32 is mounted at a position that detects the climber reaching the selected height of the climbing wall 24. The type of sensor used will be a factor in determining where sensor 32 is mounted. For example, sensor 32 may be mounted in position 32*a* or 32*b* or in any other suitable position depending on the configuration of the facility in which the climbing wall is located.

Another suitable sensor system for sensing that the climber has clipped the auto-belay 20 to the sit harness includes a climber sensor that the climber has on their person, a sensor on the auto-belay and a climber height sensor similar to sensor 32 to detect the climber passing a selected height. The climber sensor can be a radio frequency sensor. The climber sensor can also be any suitable sensor that provides a wireless signal. The climber sensor may be provided to the climber when the climber enters the facility to register and/or pay for the climbing session. The climber sensor can be in the form of an ID tag. In addition, it can be located in the climber's harness. The important characteristic of the climber sensor is that the climber has the climber sensor prior to attaching the auto-belay rope to the harness. The auto-belay rope also has a sensor that cooperates with the climber sensor. The sensor on the auto-belay may also be a radio frequency type sensor. The important characteristic is the cooperation between the two sensors. When the two sensors are brought in close proximity of each other an indication is created and sent to the computer system that the climber has attached the auto-belay rope to the harness. As the climber climbs the wall and reaches the selected height, the climber height sensor of this system then senses the presence of the climber at the selected height. The computer then compares the presence of the climber at the selected height to the signal being received from the climber sensor and the sensor attached to the auto-belay as to whether or not the auto-belay rope is attached to the harness or whether it is stilled attached to the wall. It should be understood that various sensor technologies may be used to achieve the same result that sense whether or not the climber is attached to the auto-belay rope.

Other suitable sensors to sense that the climber is attached to the auto-belay rope when ascending the climbing wall may include sensors that sense a magnetic field.

Figure 5:
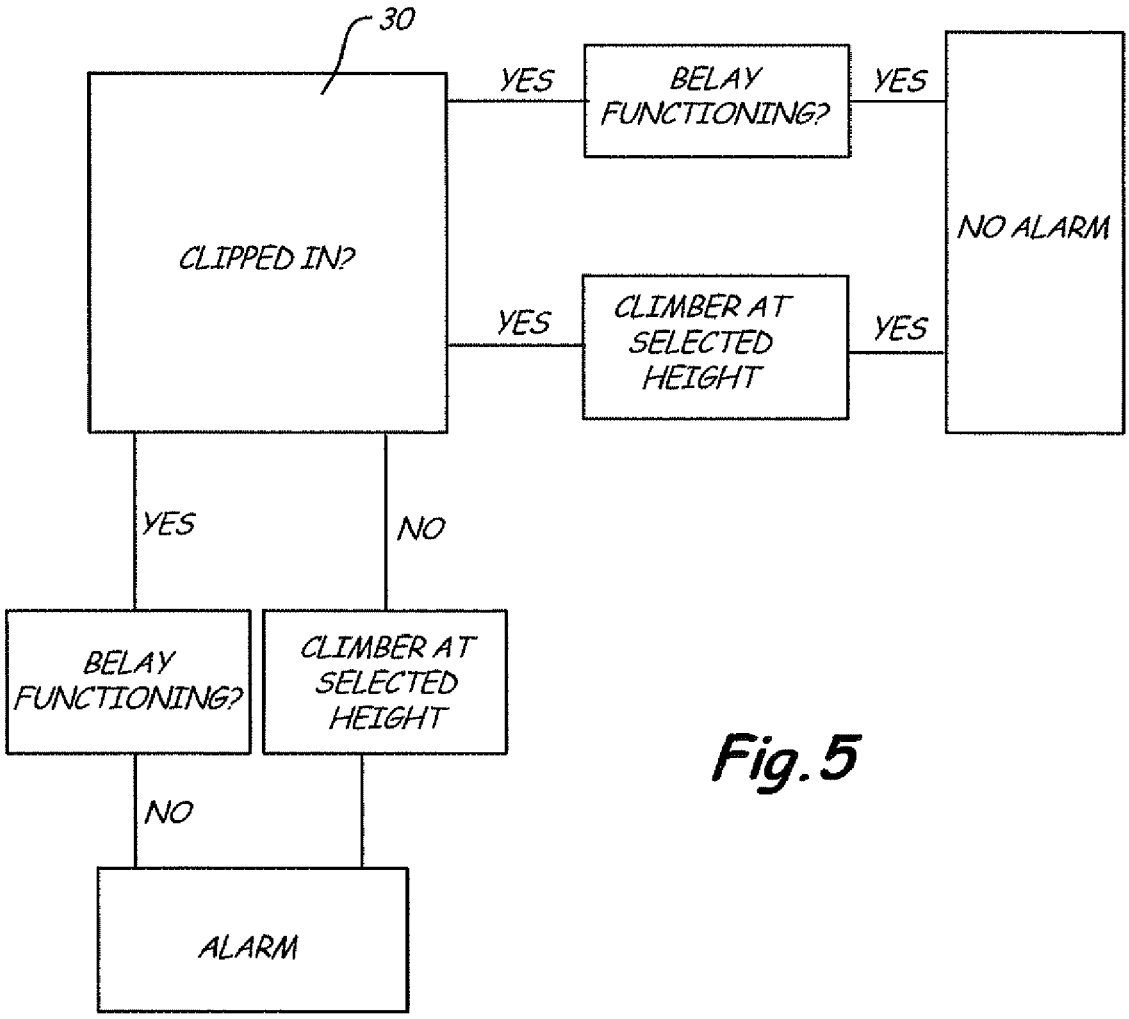
FIG. 5 is a diagramatical view of one sensing feature of the present invention.

Furthermore, the present invention also includes within its scope a series of sensors that may detect the progress of the climber as the climber climbs up the wall 24 and therefore when the climber passes the selected height. If the climber is clipped into the auto-belay warning system and then reaches the selected height, no alarm is triggered as indicated in FIG. 5. If the climber does not clip in, and reaches the selected height, then a warning alarm is set off.

The warning alarm can be of any type. The warning alarm can be flashing lights, or the warning alarm can be an audio alarm such as a horn operated at a high enough decibel level that the climber and the appropriate staff at the facility are warned that a climber has reached the selected height and is not clipped into the auto-belay system. The warning alarm also can be a signal sent to pagers, cell phones, or any other wireless device carried by the facility's staff. The relay system 35 can be programmed to initiate a single warning alarm or all of the warning alarms or any number in between.

Figure 6:
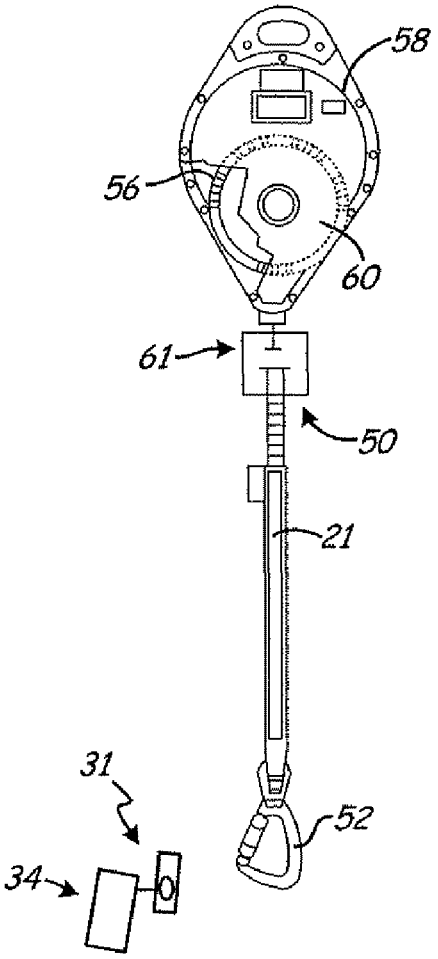
FIG. 6 is a perspective view of a spring loaded reel auto-belay system.

The auto-belay functioning sensor 34 detects whether or not the auto-belay system is functioning. The type of sensor employed will depend on the type of auto-belay system being used. For example, if the auto-belay system is a spring-loaded pulley tensioning system 50 as illustrated in FIG. 6, the sensor may be one that detects that the climbing rope or cable is not moving. The spring loaded pulley tension system includes a clip 52 that clips onto the harness of the climber. The climbing rope or cable 21 is wound onto a reel 56 disposed within a housing 58. The reel 56 is an example of a spring loaded device that keeps the climbing rope 21 in tension. A brake 60 acts on the reel during a fall by the climber or when the climber descends the climbing structure. Such an auto-belay system is available commercially and is sold under the trademark Redpoint Descender by Mine Safety Appliances Company of Pittsburgh, Pa. The housing 58 is attached overhead of the climbing structure and the clip 52 is secured to the anchor bolt 31 on the climbing wall proximate to where the climber starts his or her ascent as illustrated in FIG. 1. The auto-belay functioning sensor 34 is mounted on the bolt hanger to sense the tension from the auto-belay. When the climber attaches the clip 52 to the harness and ascends the wall, the climbing rope 21 will move upwardly and be taken up by the reel 56. The auto-belay function sensor will detect the lack of tension from the auto-belay, signaling that the auto-belay is being used. The auto-belay function sensor could also be included within the housing 58 to sense that the reel 56 is turning when taking up the slack of the rope created by the climber climbing. However, presently this is not possible since the manufacturer of this type of auto-belay system will not recognize its warranty if the housing is disturbed. In view of this, the auto-belay function sensor that senses that the climbing rope is moving is placed exterior of the housing 61, but for purposes of this application both locations are included within this invention.

Figure 7:
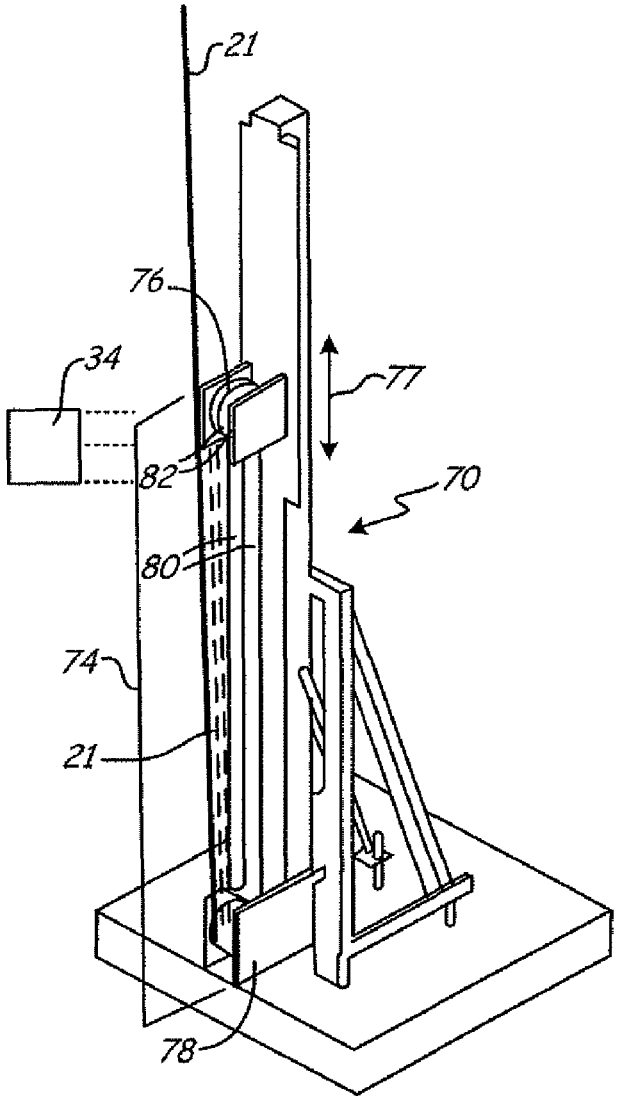
FIG. 7 is a perspective view of a hydraulically actuated auto-belay system.

The auto-belay system illustrated in FIG. 2 that is hydraulically operated is better illustrated in FIG. 7 where it is generally indicated at 70. Using the auto-belay system 70, the sensor 34 may be used to sense motion of the pulley system 74 or in addition to tension of the climbing rope. The pulley system 74 includes upper 76 and lower 78 pulley assemblies. In the embodiment illustrated, the pulley assembly 78 is attached to a pair of hydraulic cylinders 80 through the hydraulic cylinder's piston rods 82. The climbing rope 21 is positioned within the pulley system and as the climber ascends, the pulley assemblies 76 and 78 move away from each other as indicated by arrow 77 due to the hydraulic pistons 80 biasing the pulley assemblies from each other. The sensor 34 senses the movement of the pulley assembly 76. Alternatively the sensor 34 may be used to sense the movement of the piston rod or rods 82. If the climber falls off the climbing structure or wishes to descend, the hydraulic cylinder resists movement of the pulley assemblies towards each other with sufficient force to substantially support the climber so the climber does not fall in free fall. Such an auto-belay system is more fully illustrated and described in U.S. Pat. Nos. 6,083,142 and 6,390,952 both of which are herein incorporated by reference in their entirety.

The auto-belay functioning sensor 34 can work in cooperation with the clip-in sensor 30. Once the auto-belay is taken off the hanger bolt and clipped onto the harness, and the auto-belay functioning sensor 34 detects motion in the climbing rope or motion in the pulley assembly or hydraulic cylinder (whichever the case may be), while the climber sensor 32 senses a climber then no alarm is initiated. If the auto-belay functioning sensor 34 detects no motion in the climbing rope or no motion in the pulley assembly or hydraulic cylinder (whichever the case may be), and the climber sensor 32 detects a climber then an alarm is initiated as discussed previously.

The safety system 10 of the present invention also includes a warning or alert when the auto-belay clip is found at the top of the wall. In this situation, it is important for the management of the facility or for the owner of the climbing wall structure to know that the auto-belay is not readily available for use by a climber. Since auto-belay systems are typically in tension, such a situation can occur quite easily. For example, a climber at the end of his or her climbing session may have the auto-belay slip out of his or her hands and the auto-belay clip rise up to the top of the wall 24. Leaving the area out of embarrassment or in search of a staff member to retrieve the auto-belay, may pose a safety incident if another climber, not knowing that the auto-belay is at the top of the structure 24, starts to climb without using the auto-belay.

The system 10 also includes a climbing rope malfunction sensor 38. This sensor senses the climbing rope or cable in the event that the rope wanders laterally (horizontally) from the ropes intended position. One such suitable sensor includes a pair of switches spaced apart that detect the climbing rope or cable when the climbing rope or cable traverses either switch. Such a sensor aids in discovering that the climber may have strayed from the permitted climbing route and is now posing a safety hazard.

The present invention also includes a control unit that includes a power supply to power various aspects of the system. Preferably, the computer 35 and other controls are in a central location and includes a panel with lights to indicate the state of the system and may include switches to deactivate or activate the various sensors discussed previously. The computer can also be used for collection, analysis and distribution of data. For example, the computer can collect data on how many climbing cycles the auto-belay rope or cable has experienced. This can provide the owner of the climbing structure information on when to change the climbing rope or cable before it fatigues, thereby avoiding a safety incident. The computer can also analyze the amount of traffic in relation to a particular time and/or date, or day of week by compiling how many times the auto-belay was used.

The computer can also be used in competitive climbing situations. Additional sensors can be added to selected hand or foot holds along the climbing route that the climbers have to activate during a climb. Such a system can also be used to track the climbing of identified users, including the height that they climb, the speed at which they climb, and the amount of time that the climber has used to climb the wall. The system can also be used in side by side races with sensors positioned at a height destination which will indicate which climber achieved that height first. A climber can also challenge a computer software program which includes specified climbing routes at specified skill levels with the climber attempting to meet or beat the computer based on the difficulty of a particular climb and the skill level of the climber.

The computer system can also track for an identified climber completions versus attempts for various climbing routes, utilizing sensors at selected footholds. Individual climbers can use such data to mark their progress in the sport or compare themselves to others who are using those same routes.

The computer 35 can also analyze the data for a particular climb and give positive encouragement to the climber such as an audio musical tone, a verbal audio congratulation, upon reaching the top, or even a light-hearted audio kidding if the climbing route was not completed.

An additional sensor or sensors can also be used to measure the speed of the descent by measuring the speed (velocity) of the moving rope or cable thereby giving a warning that the climber was too heavy for the auto-belay system or that the auto-belay system may be malfunctioning on descent.

The system 10 can also alert the climbing structure's owner that someone has been climbing the system during closure of the facility or climbing wall indicating unauthorized or unsupervised use or both. In addition, if the climbing structure has climbing height restrictions, sensors can be placed and used by the system 10 to alert if a climber climbs beyond the limited height, or if a climber climbs over the climbing wall 24.

Although the present invention has been described with reference to preferred embodiments, workers skilled in the art will recognize that changes may be made in form and detail without departing from the spirit and scope of the invention.

What is claimed is:

1. A warning system for use with a climbing wall and an automatic belay apparatus for belaying a climber, the warning system providing a warning that a climber is not protected by the auto-belay apparatus, the warning system comprising:

a first sensor positioned to sense that a lower end of the climbing rope is secured to the climbing wall and providing a first signal;

a second sensor on the climbing wall at a selected height for sensing when the climber has reached the selected height on the climbing wall and providing a second signal;

a warning alarm; and a processor for receiving the first and second signals and comparing the first and second signals to determine if the climber has reached the selected height with the lower end of the climbing rope still secured to the wall and then activating the warning alarm.

2. The warning system of claim 1 and further comprising an auto-belay functioning sensor providing a third signal for sensing that the automatic belay apparatus is functioning.

3. The warning system of claim 2 wherein the auto-belay functioning sensor senses movement of the climbing rope or cable.

4. The warning system of claim 2 wherein the upper end of the climbing rope is disposed on a rope reel that turns as the climbing rope moves, and the auto-belay functioning sensor senses turning of the rope reel.

5. The warning system of claim 1 and further comprising an auto-belay clip attached to the lower end of the climbing rope and an auto-belay clip sensor positioned at an upper end of the climbing wall providing a fourth signal to detect the auto-belay clip at the top of the climbing wall.

6. The warning system of claim 5 and further comprising an alert and wherein the auto-belay clip sensor when sensing the auto-belay clip at the top of the wall issues an alert.

7. The warning system of claim 1 and further comprising a climbing rope malfunction sensor providing a fifth signal for detecting lateral position of the climbing rope and whether that position is outside of the position intended for the climbing rope.

8. The warning system of claim 7 wherein the climbing rope malfunction sensor is positioned proximate the top of the climbing wall.

9. The warning system of claim 7 wherein the climbing rope malfunction sensor includes a pair of spaced apart sensors and the intended position of the climbing rope to be between the sensors and the sensors capable of sensing that the rope has moved from the position between the sensors.

10. The warning system of claim 1 and further comprising a computer for collecting data from the sensors.

11. The warning system of claim 10 wherein the computer collects data on the number of climbing cycles that the climbing rope has experienced.

12. The warning system of claim 10 wherein the computer includes software capable of analyzing the number of times that the climbing rope has been used in relation to time.

13. The warning system of claim 10 and further comprising a plurality of sensors positioned on the climbing wall, each of the sensors providing data to the computer, and the computer including software to receive and store the data, and wherein the sensors sense a position of the climber on the climbing wall when the climber engages the sensor, the computer being capable of providing the climbing route of the climber.

14. The warning system of claim 10 and further including a speed sensor or sensors that measures the speed of the climbing rope.

15. The warning system of claim 10 and further including height restriction sensors disposed at a selected upper position on the climbing wall capable of sensing the climber to climb past the height restriction sensors.

* * * * *